United States Patent [19]

Fossati

[11] 3,979,584

[45] Sept. 7, 1976

[54] MODULAR CHANDELIER

[76] Inventor: George Fossati, 337 E. Palisades Blvd., Palisades, N.J. 07650

[22] Filed: Jan. 22, 1975

[21] Appl. No.: 543,152

[52] U.S. Cl. ..... 240/78 F; 248/223; 248/323

[51] Int. Cl.[2] ..... F21S 1/06; F21S 3/06

[58] Field of Search ..... 240/78 F, 78 E, 10 T, 240/10 Q; 248/342, 343, 344, 323, 324, 74, 223, 224

[56] References Cited

UNITED STATES PATENTS

| | | | |
|---|---|---|---|
| 3,354,305 | 11/1967 | Spicer et al. | 240/78 R X |
| 3,683,171 | 8/1972 | Sclafani | 240/78 F |
| 3,735,123 | 5/1973 | Porter et al. | 240/78 F |
| 3,745,330 | 7/1973 | Frost | 240/78 F |
| 3,831,022 | 8/1974 | Porter et al. | 240/78 F |

*Primary Examiner*—Richard A. Wintercorn
*Attorney, Agent, or Firm*—Oblon, Fisher, Spivak, McClelland & Maier

[57] ABSTRACT

A modular chandelier whose various decorative elements may be quickly and conveniently disassembled and reassembled to assume numerous different configurations is disclosed. The chandelier includes a central module carrying a plurality of electrical sockets for receiving suitable decorative bulbs. The central module includes a ring structure for removably mounting radially extending decorative arms. An axial shaft passing through the central module also carries at least one omnidirectional connector having a plurality of uniquely shaped interior grooves positioned around its periphery in which a like plurality of curved decorative or supporting shafts may be coupled. The groove structure of the omnidirectional coupler is such that the curved decorative or supporting arms may be mounted in any of six alternative positions. The apparatus provides a number of advantages in that components can be readily removed for cleaning, no tools are required for adding or removing decorative components, the decorative structure of the chandelier can be easily modified and the entire modular chandelier can be marketed in kit form or with a basic kit and numerous types of add-ons.

9 Claims, 9 Drawing Figures

MODULAR CHANDELIER

BACKGROUND OF THE INVENTION

1. Field of the Invention

The present invention relates generally to a chandelier, more particularly to a modular chandelier whose various decorative elements can be quickly and conveniently disassembled and reassembled to assume numerous different configurations.

2. Description of the Prior Art

In many homes, restaurants and commercial establishments, decorative chandeliers occupy permanent positions and contribute greatly to the beauty and style of the rooms in which they hang.

Such chandeliers are often very expensive and constitute a significant investment from the point of view of the individual home owner or from the point of view of the builder or developer of larger commercial establishments requiring numerous chandeliers. Accordingly, much attention is directed to the upkeep and maintenance of expensive chandeliers, since they often require polishing or cleaning to maintain their full ornamental effect, particularly were they include crystal decorative beads.

Furthermore, the high cost of removing or replacing chandeliers often creates a significant problem when one wishes to redecorate a room or establishment having an existing chandelier in place. In such instances, one is often extremely reluctant to discard a fine chandelier in good condition even though it will not conform to the proposed new decorating scheme of the room or establishment. However, the cost of replacing a chandelier completely is often not justified, with the result that in many cases those who wish to redecorate either refrain from doing so or are forced to live with chandeliers that do not conform to their desired decorative schemes.

Some efforts at resolving these problems have been made in the past in the form of chandeliers that can be modified or adjusted in some respect. For example, reference is directed to U.S. Pat. No. 1,629,489 to Dvorak which discloses a lighting fixture in which arms supporting bulbs and glassware may be removed from the device or put into the device in different configurations. However this device is extremely inconvenient to use in that it requires threaded fixtures and in that removal of parts or adjustment of the device results in interfering with the electrical leads used to power the bulbs. Accordingly the device disclosed in this patent is relatively impractical and inconvenient to use. Similar comments apply to the foldable chandelier disclosed in U.S. Pat. No. 1,059,742 to Lumley, wherein the movable or foldable portions of the chandelier include electrical wires, and thus can not be conveniently removed. U.S. Pat. No. 1,045,273 to Fisher discloses a chandelier in which bulb sockets mounted to arms carrying electrical connectors may be plugged into a central chandelier component. However again, the apparatus disclosed in this patent does not include a sufficient amount of flexibility nor does it permit the degree of convenience and utility desired of chandelier structures.

More recent developments in adjustable chandeliers are disclosed in U.S. Pat. No. 3,683,171 to Sclafani and U.S. Pat. No. 3,735,123 to Porter et al. The devices disclosed in these patents similarly lack a large degree of flexibility in terms of removal and replacement of decorative components and do not permit complete restyling of chandeliers without the use of tools or major metal working steps.

Accordingly a need exist for a truly versatile modular chandelier which can be easily disassembled without the use of tools by an unskilled person with a minimum of time and effort. It is noted that the ability to disassemble and reassemble a chandelier without tools provides a great advantage since tools often scrape or deface the highly polished, plated finishes of expensive chandeliers.

A need also exists for a technique of providing high quality individually customized chandeliers at reduced cost.

SUMMARY OF THE INVENTION

Accordingly, one object of the invention is the provision of a novel modular chandelier structure.

Another object of the present invention is the provision of a modular chandelier wherein the various elements thereof may be quickly and conveniently disassembled and reassembled in a minimum amount of time and in a most simple manner.

Yet another object of the present invention is the provision of a novel modular chandelier which may be modified, assembled and disassembled without the use of tools.

Yet another object of the present invention is the provision of a novel apparatus whereby customized chandeliers of high quality may be produced at an extremely low cost.

A still further object of the present invention is the provision of a chandelier having unique coupling features whereby decorative elements may be easily added, removed or mounted in many alternative positions.

A still further object of the present invention is the provision of a novel modular chandelier structure which may be easily and conveniently disassembled for cleaning or servicing and may be similarly reassembled with great ease at a subsequent time.

Briefly, these and other objects of the present invention are achieved by the provision by a novel modular chandelier having unique coupling features whereby decorative elements may be inserted and locked into position by appropriate coupling fittings acting through interference or friction fits. No tools are required to mount or dismount the decorative elements in view of the mechanical couplings provided. The mechanical coupling are arranged such that individual decorative elements can be removed and reassembled on the chandelier in different positions whereby the overall design of the chandelier can be modified without adding new parts thereto. The invention permits high quality customized chandeliers to be produced at low cost simply by the construction of customized fittings adapted for use with a basic modular chandelier unit including the coupling system of the present invention.

BRIEF DESCRIPTION OF THE DRAWINGS

A more complete appreciation of the invention and many of the attendant advantages thereof will be readily obtained as the same becomes better understood by reference of the following detailed description when considered in connection with the accompanying drawings, wherein.

DETAILED DESCRIPTION OF THE PREFERRED EMBODIMENTS

Figure 1:
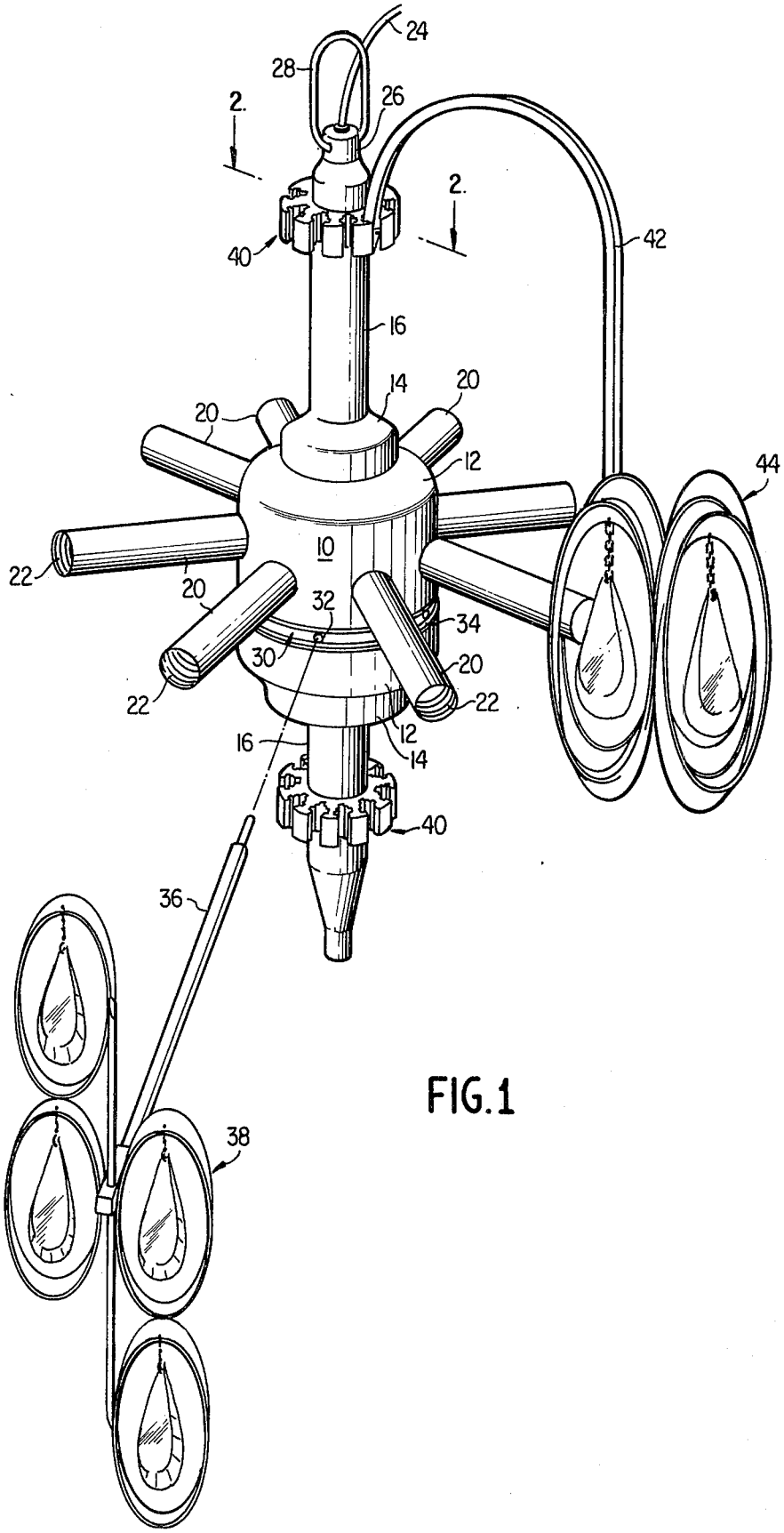
FIG. 1 is a perspective and partially exploded illustration of the modular chandelier of the present invention illustrating two different types of decorative couplings.

Referring now to the drawings, wherein like reference numerals designate identical or corresponding parts throughout the several views, and more particularly to FIG. 1 thereof, the modular chandelier of the present invention is shown as including a central module 10. The central module 10 is shown as having a generally cylindrical configuration with rounded upper and lower corner portions 12 and reduced end cap portions 14 positioned outside the corner portions 12. A pair of tubular extensions 16 are positioned outwardly from the end caps 14 at opposite sides of the central module 10. The central module 10 along with the attached end caps and tubular portions is generally hollow to provide room for suitable electrical connections to a plurality of radially extending bulb arms 20, each having a conventional bulb receiving socket 22 at the end portion thereof. A power input lead 24 is shown passing through a suitable aperture in a support cap 26 secured to an upper end of one of the tubular extensions 16. The power line 24 is coupled to the bulb sockets 22 within the central module of the chandelier to permit the application of electrical power to the bulbs.

A chain link 28 is shown coupled to the support cap 26 whereby the chandelier may be supported from a ceiling joist, or other conventional support.

An aperture ring 30 forms a cylindrical portion of the exterior wall the central module 10, and is positioned below the bulb arms 20 in the illustrated embodiment of the invention. The aperture ring 30, which may be formed as a groove with the central module 10 or which may alternatively be separately machined and assembled with the various components forming the central module 10, includes a plurality of mounting apertures 32 evenly spaced about its perimeter and includes a pair of alignment flanges 34 positioned above and below the various apertures 32 and extending around the entire periphery of the aperture ring.

The apertures 32 are adapted to receive split pin support arms 36 which may have suitable ornaments 38 mounted to end portions thereof.

A pair of slotted connector rings are rotatably mounted on the tubular extension 16 above and below the central module 10 for receiving a plurality of multiple pinned support arms 42. These arms may also carry suitable ornaments as illustrated at 44 in the figure.

Figure 2:
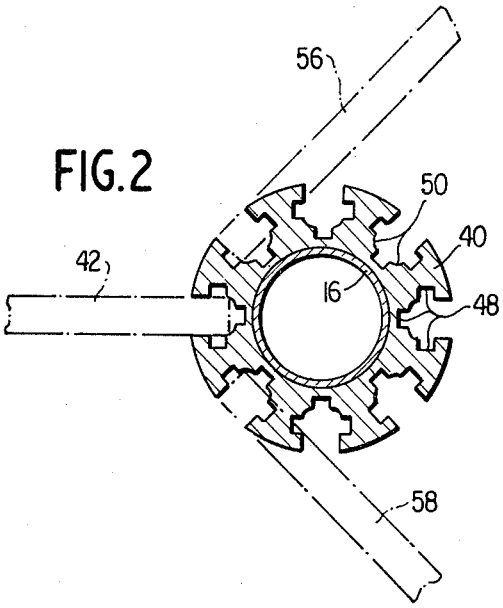
FIG. 2 is a plan view of one of the unique mechanical coupling components of the present invention illustrating three alternative positions for one of the curved coupling arms.
Figure 3:
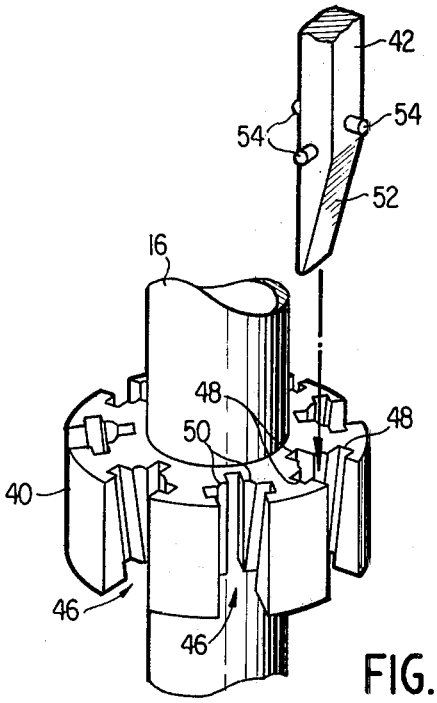
FIG. 3 is a perspective illustration of the mechanical coupling element shown in FIG. 2 showing the manner in which a coupling arm may be inserted therein.
Figure 4:
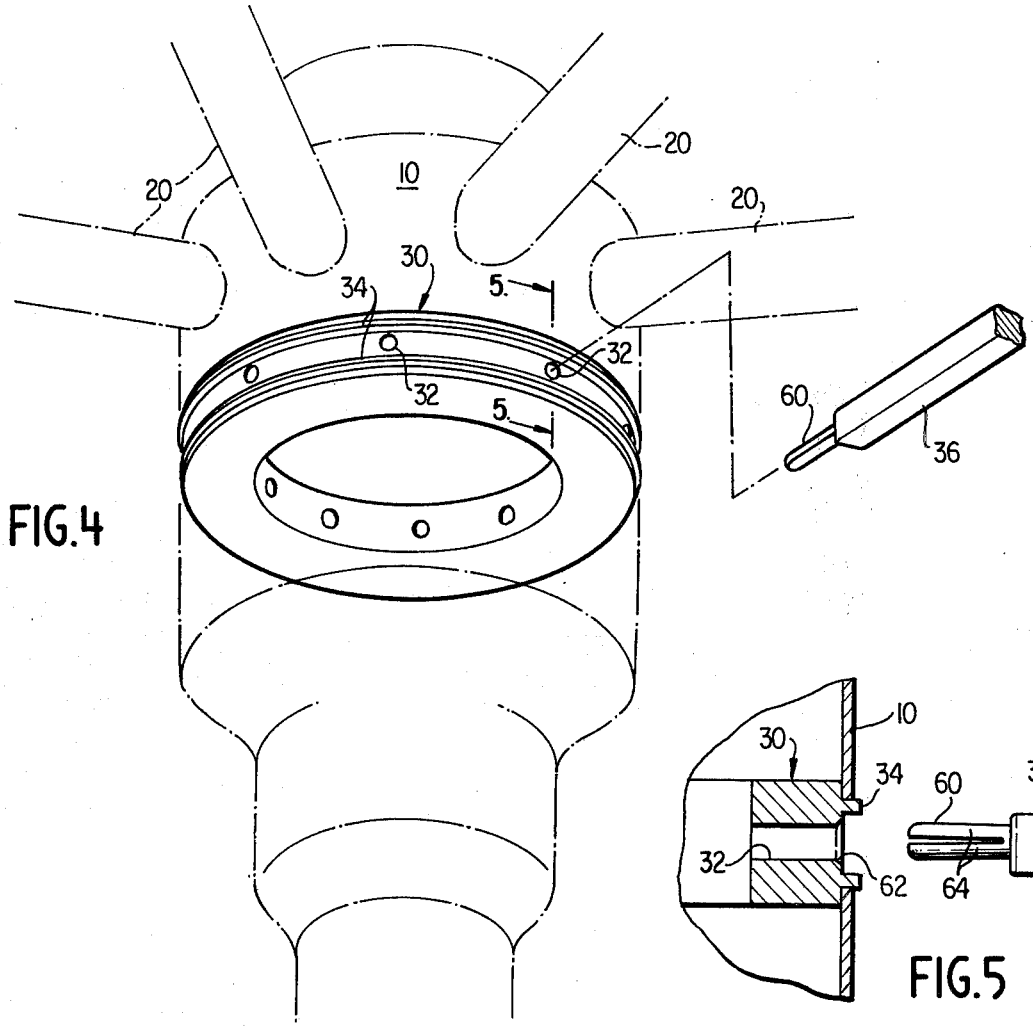
FIG. 4 is an enlarged perspective view of a central portion of the modular chandelier structure showing the details of the central coupling ring and illustrating in exploded form the manner in which one of the straight decorative arms may be coupled thereto.

The details of the coupling structures are shown more clearly in FIGS. 2, 3 and 4. Referring particularly to FIGS. 2 and 3, the detailed structure of the slotted connector rings 40 is shown in more detail. As shown in FIG. 2, each of the slotted connector rings includes a plurality of evenly spaced openings 46 about its periphery. Each of the openings includes three separate pin channels 48 separated from one another by interior protrusions 50. The pin channels 48 are angularly spaced from one another by 90° degrees. The two pin channels which face one another are angled inwardly toward the shaft 16, as shown more clearly in FIG. 3. This inward sloping of the pin channels provides a friction locking feature as multiple pinned support arms 42 are inserted in place.

FIG. 3 illustrates the insertion of a multiple pinned support arm 42 into one of the openings 46. The multiple pinned support arm may include a tapered lower extremity 52 above which four guide pins 54 (one of which cannot be seen in the figure) extend outwardly from the four faces of the generally square multiple pinned support arm 42. The guide pins are shown as two perpendicular pairs of pins, each pair occupying a different plane along the axis of the multiple pinned support arm 42. The purpose of spacing the planes occupied by the guide pins is two fold. First, the guide pins may be solid pins positioned in apertures drilled through the structure of the multiple pin support arm. In this case, the pins must occupy separate planes in order to be inserted through the appropriate apertures without interference. Second, the separation of the planes occupied by the pins also serves to improve the stability and locking strength of the joint formed by the pins and the pin channels.

Upon insertion of a multiple pin support arm 42 into one of the openings 46, one pair of guide pins 54 engages the laterally opposed and inwardly slanted pin channels 48, while the inwardly directed one of the remaining pair of guide pins occupies the guide channel adjacent to the central portion of the slotted connector ring 40. As the guide pins 54 slide down the pin channels 48, the inward slope of the pin channels causes the inwardly facing corners of the arm 42 to abut the interior protrusions 50 forming an interference fit therewith. Accordingly, by pressing the arm 42 firmly in place, a firm interference fit is formed with the interior protrusions 50, whereby the arm 42 is secured in place. Thus the guide pins 54 together with the pin channels 48 serve as both an aligning and a camming apparatus for locking the arms 42 in place.

FIG. 2 illustrates several different positions which can be occupied by the multiple pinned support arms 42. As shown in FIG. 2, the arm 42 at the left is mounted so that it is directed perpendicular to the circumference of the slotted connector ring 40. However, an upper arm 56 is shown as angled outwardly in a configuration which is generally tangential to the circumference of the slotted connector ring, and a lower arm 58 is also shown in a tangential configuration, but oppositely directed with respect to upper arm 56. Thus three mounting configurations are illustrated in FIG. 2. However, the arms can also be turned over and inserted in the same three angular positions, providing a total of six possible positions which can be occupied by any of the multiple pinned support arms 42. Although in most cases all arms would be inserted into the slotted connector rings 40 in the same angular position for reasons of symmetry, it is of course possible that intermixed angular configurations as shown in FIG. 2 could be adopted by users of the present invention.

Figure 5:
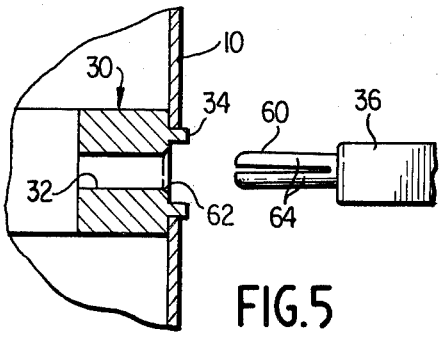
FIG. 5 is a partially cut away side view of one of the openings in the coupling ring illustrated in FIG. 4 showing in more detail the insertion of one of the straight coupling arms therein.

FIG. 4 illustrates in greater detail the aperture ring 30 illustrated generally in FIG. 1. The aperture ring 30 is an annular structure having a plurality of evenly spaced mounting apertures 32 and having alignment flanges 34 positioned on opposite sides of the apertures as previously mentioned. The apertures 32 are designed to accomodate slotted locating pins 60 formed on the split pin support arms 36. As shown more clearly in FIG. 5, each of the mounting apertures 32 may include an angled lip 62 for directing the slotted locating pins 60 toward the mounting apertures 32 and for providing a slight camming action to squeeze together the two prongs forming the slotted locating pins. Thus, upon insertion of the slotted pin support arms 36 into the mounting apertures 32, the slotted locating pins are compressed for providing a reasonably tight interference or friction fit between the arms and the aperture ring. The alignment flanges 34 cooperate with the upper and lower faces of the generally square or rectangular arms 36 to prevent the arms from rotating when in place. Thus, relatively heavy ornaments may be hung at the ends of the arms 36 without any danger that the arms will rotate, even if the ornaments are nonsymmetrically weighted with respect to the axis of the arms 36.

Figure 6:
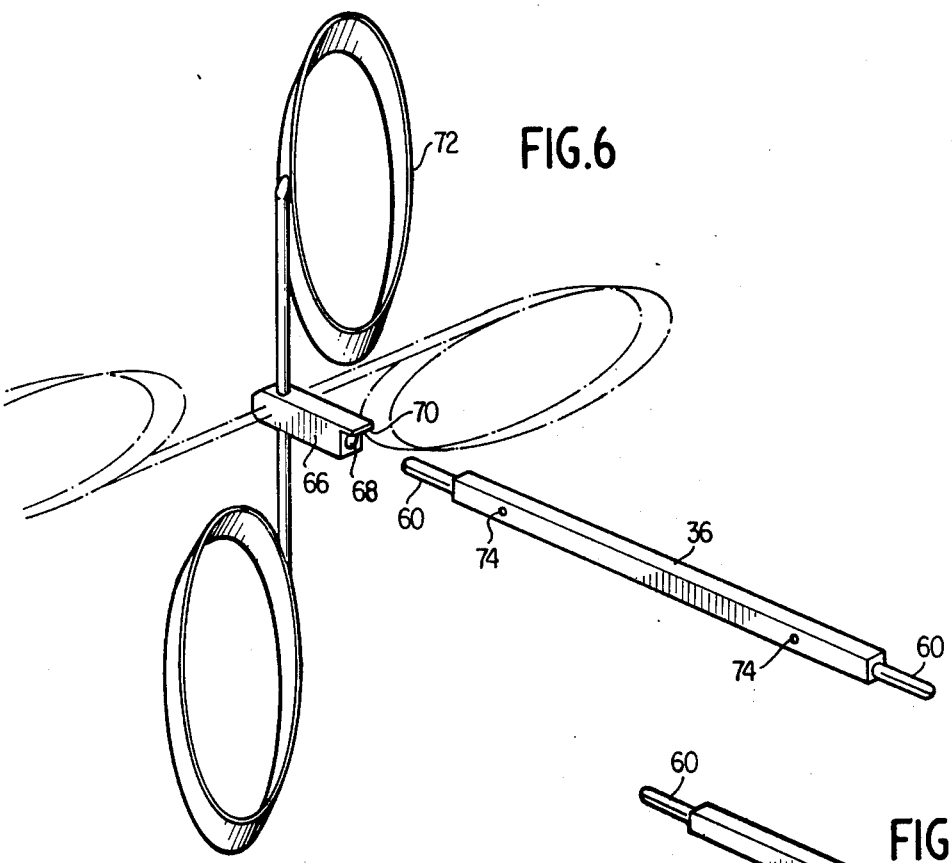
FIG. 6 is an exploded perspective illustration of a straight coupling arm and a decorative end fixture adapted to interfit therewith.
Figure 7:
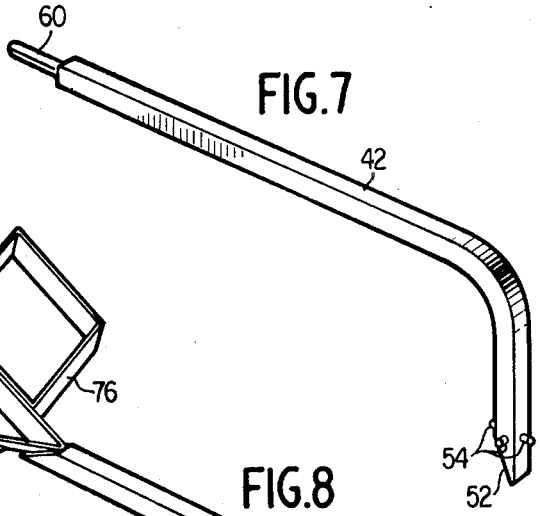
FIG. 7 is a perspective illustration of one form of curved coupling arm.
Figure 8:
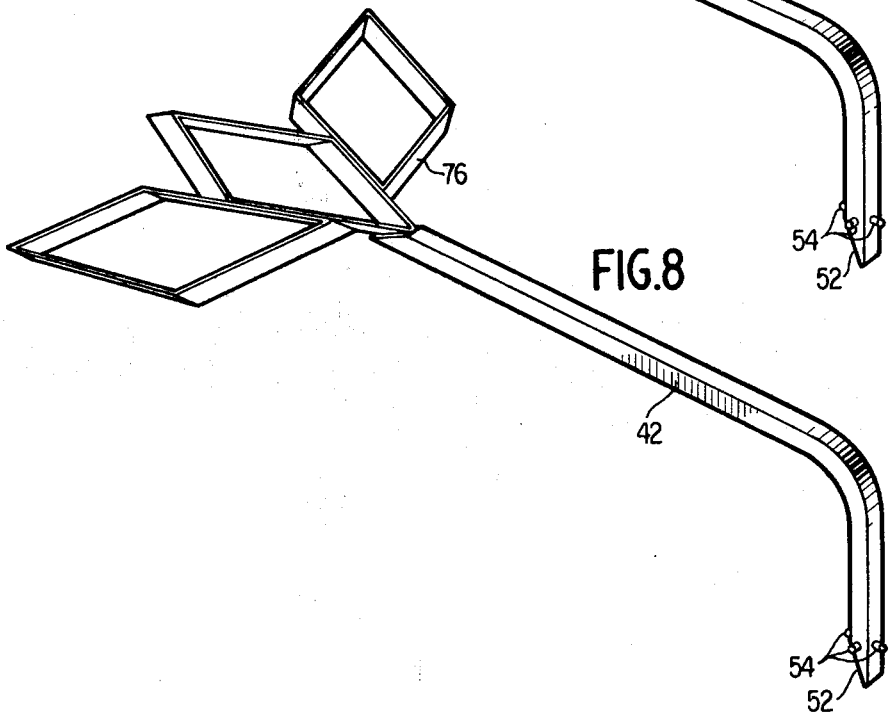
FIG. 8 is a perspective illustration of another form of curved coupling arm; and, FIG. 9 is a plan view of one of the mechanical coupling elements of the present invention illustrating the "spoke" configuration of decorative elements.

FIGS. 6, 7 and 8 illustrate three of the basic types of support arms usable with the present invention. In particular, FIG. 6 illustrates a split pin support arm 36 having slotted pins 60 at both ends thereof. An ornament carrier 66 is illustrated for cooperating with the end of the arm 36 which is spaced from the aperture ring 30. The ornament carrier includes a mounting aperture 68, which is preferably identical to the mounting apertures 32 illustrated in FIG. 5. A single alignment flange 70 is formed integral with the ornament carrier 66 for abutting one surface of the arm 36 to prevent rotation of the ornament carrier 66 with respect to the arm. An ornamental design 72 is shown fixed to the ornament carrier 66. It will be clear to those skilled in the art, however, that any type of suitable ornamental design or structure can be used in place of the particular ornamental design illustrated in FIG. 6.

As an alternative to that illustrated in FIG. 6, the ornamental design 72, or any equivalent thereof, can be directly secured to the split pin support arm 36, eliminating the need for one of the slotted locating pins 60 and eliminating the need for the ornament carrier 66. Naturally, this technique reduces the overall flexibility of the modular chandelier system of the present invention somewhat since the entire split pin support arm structure would then have to be replaced each time designs are changed. It is also noted that suitable apertures 74 may be provided along the split-pin support arm 36 for the purpose of hanging glass or crystal beads therefrom. The apertures 74 may be centered so that the beads may be appropriately hung regardless of the angular orientation of the arm 36. Hanging glass beads from the support arm structure is particularly advantageous in the context of the present invention, since the support arm 36 may be easily removed from the central chandelier module 10, and any decorative ornament 72 mounted to one end thereof may also be removed. Thus the arm 36 along with any glass beads attached thereto may simply be removed from the chandelier structure and put into a dish washer or the like for rapid and complete cleaning, whereby the chandelier structure of the present invention can provide a spectacular advantage over conventional structures in its ease of cleaning.

FIG. 7 illustrates a multiple pin support arm 42 having the previously described guide pin 54 at one end thereof and having a slotted locating pin 60 at the opposite end thereof. The arm 42 has a substantial curvature between its two ends, preferably approximately 90°, although a wide range of curvatures can be used with the apparatus of the present invention. The arm illustrated in FIG. 7 may be used to mount one of the ornament carriers 66 of the type illustrated in FIG. 6 to one of the slotted connector rings 40 in the manner previously described.

A variation of the arm shown in FIG. 7 is illustrated in FIG. 8 wherein a suitably curved multiple pinned support arm 42 is shown with an ornament 76 rigidly fixed to one end thereof. This embodiment is similar to the fixed ornament structure described above with regard to FIG. 6. This structure somewhat reduces the flexibility of the apparatus of the present invention in that it does not permit removal of the ornament 76 from the arm 42.

It will be of course apparent that the arms 42 may also include apertures of the types shown at 74 in FIG. 6 for the purpose of supporting decorative glass beads from the arms 42.

Figure 9:
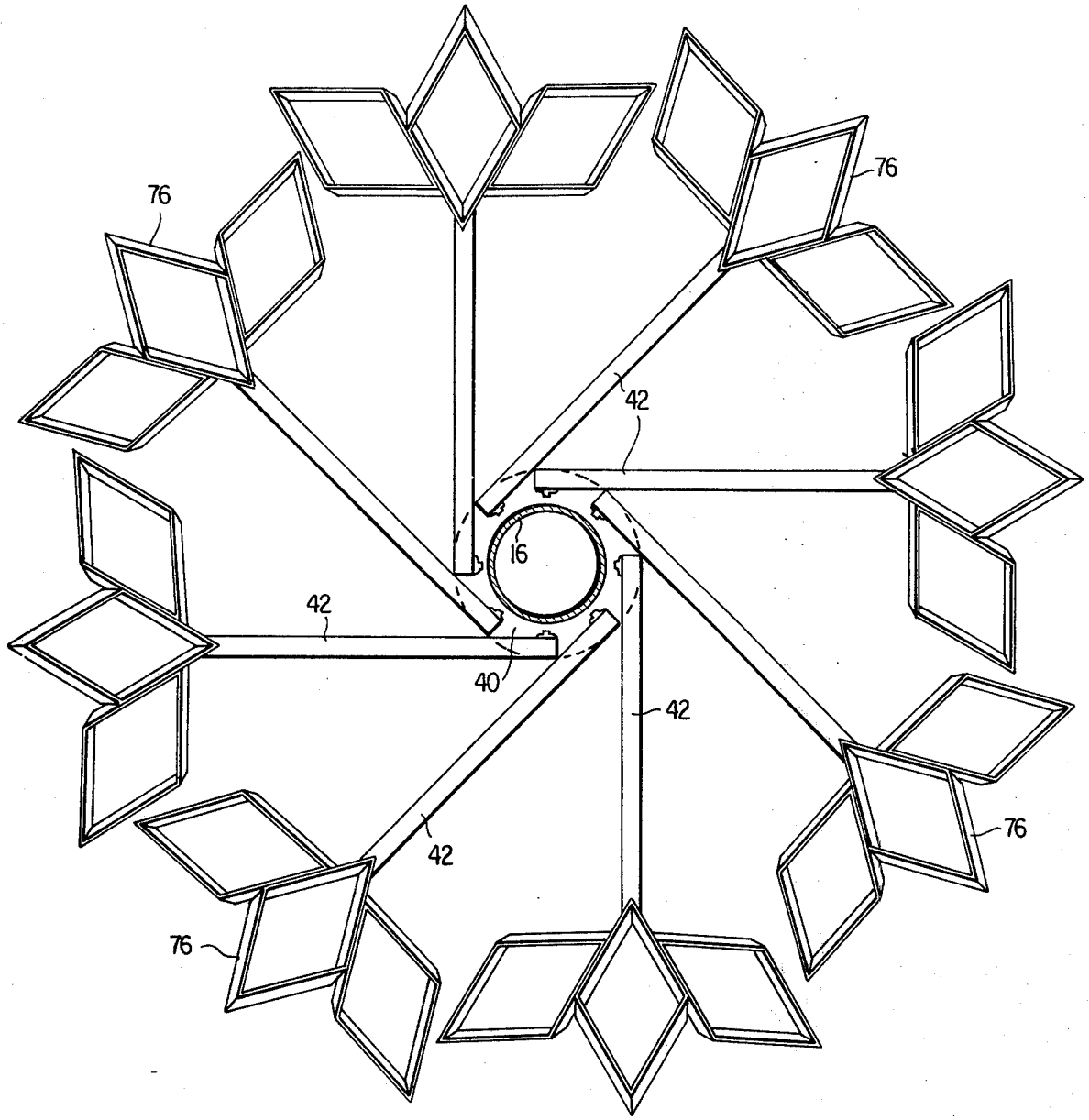

FIG. 9 illustrates one example of a slotted connector ring 40 having multiple pinned support arms 42 mounted in all of its openings 46. The arrangement illustrated in FIG. 9 is referred to as the "spoke" arrangement in that it is somewhat similar in configuration to a bicycle wheel. According to the invention, the arms 42 may be removed from the illustrated positions and placed in a "spoke" arrangement rotating in the opposite direction from that shown, or may alternatively be positioned so that the arms 42 are angled perpendicular to the circumference of the slotted connector ring 40. Alternatively, all of the arms 42 may be inverted, or alternative arms may be inverted whereby an extremely large number of alternative designs can be achieved with the illustrated components.

It is believed that many of the advantages of the present invention will be apparent to those skilled in the art from the proceeding disclosure. The present invention provides a modular chandelier structure having many unique mechanical coupling features which permit its design to be changed readily and simply without the need for tools which might scratch or otherwise damage highly polished decorative surfaces. Furthermore the design of the chandelier of the present invention can be modified with ease by purchasers of the chandelier even after it is installed in their homes or in restaurants or other commercial establishments. The chandelier of the present invention can also be easily adapted or customized to conform to any type of decorative scheme simply by producing customized ornaments of the type illustrated at 38, 44, 72, and 76 in drawings. Thus the advantages of hand crafted customized chandeliers can be provided according to the concept of the present invention at a fraction of the cost normally associated with such customization since the basic components of the chandelier can be mass produced and only the decorative ornaments need to be produced to order. Alternatively, large stocks of unique ornament styles can be produced so that individual purchasers of the chandelier can effectly design their own customized chandelier by selecting appropriate ornaments. Furthermore, the ornaments themselves may be of relatively low cost, so that they can be replaced, exchanged or even discarded after being used on a chandelier without requiring removal of the chandelier. In addition, specialized ornaments symbols, trademarks, emblems and insignias for decorating corporate offices and homes for business purposes, birthdays, holidays and the like can be produced so that users of the chandeliers constructed according to the concepts of the present invention can modify their chandeliers for any holiday, festive or business purpose.

It should also be noted that although the embodiment of the invention illustrated in FIG. 1 includes only one aperture ring 30 and two slotted connector rings 40, the invention is in no way limited to the embodiment illustrated in the figure. Thus, additional aperture rings 30 may be added, or one of the illustrated aperture rings may be removed. Furthermore, slotted connector rings in addition to the two illustrated may also be mounted to the basic chandelier structure. It should also be noted that the specific design of the central module 10 and of the bulb arms 22 is not critical to the basic concept of the present invention, and each of these can be varied or modified within the scope of the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A modular chandelier whose various decorative elements may be quickly and conveniently disassembled and reassembled to assume numerous different configurations comprising:

a central body, said central body having a plurality of openings disposed in a circle about the periphery thereof, an upper retaining edge disposed adjacent to the upper portions of said openings, a lower retaining edge disposed adjacent to the lower portions of said openings, a support rod having a non-circular cross section, said support rod having a split pin at one end thereof, said split pin being slightly larger in cross section than said openings so as to fit snugly into said openings, said support rod being so dimensioned so that, upon insertion of said split pin into one of said openings, said support rod is restrained from rotation by said upper and lower retaining edges;

whereby the split pin may be quickly and conveniently received and secured in said openings from lateral and rotational movement in any one of a plurality of positions.

2. A modular chandelier whose various decorative elements may be quickly and conveniently disassembled and reassembled to assume numerous different configurations in accordance with claim 1 wherein said support rod has a split pin at both ends thereof further comprising:

a receiving element having a first opening therein to receive said split pin and a second opening therein to receive a shaft bearing decorative elements;

said first opening being slightly smaller than the cross section of said split pin so as to snugly grip said split pin;

said receiving element having a retaining extension adjacent said first opening to contact one edge of said support rod when said split pin is inserted in said first opening to restrain said support rod from rotation;

whereby the split pin may be quickly and conveniently secured in said first opening of said receiving element from lateral and rotative movement in any one of a plurality of positions.

3. A modular chandelier whose various decorative elements may be quickly and conveniently disassembled and reassembled to assume numerous different configurations in accordance with claim 1 wherein said split pin and said plurality of openings have circular cross sections.

4. A modular chandelier whose various decorative elements may be quickly and conveniently disassembled and reassembled to assume numerous different configurations in accordance with claim 2 wherein said split pin and said first opening of said receiving element have circular cross sections.

5. A modular chandelier whose various decorative elements may be quickly and conveniently disassembled and reassembled to assume numerous different configurations in accordance with claim 1 wherein said plurality of openings comprises eight openings.

6. A modular chandelier whose various decorative elements may be quickly and conveniently disassembled and reassembled to assume numerous different configurations in accordance with claim 1 wherein said support rod has a square cross section.

7. In a chandelier, a support arm having two pairs of faces;

a first pair of pins extending outwardly from one of the pairs of faces of said support arm and occupying a first plane along the axis of said support arm;

a second pair of pins extending outwardly from the other of the pairs of faces of said support arm and occupying a second plane along the axis of said support arm; and a connector ring having on its periphery at least one opening including three separate channels angularly spaced from one another by ninety degrees, the opposing pair of channels being sloped inwardly toward the center of said ring to receive one of said pairs of pins in locking relationship while one pin of the other of said pairs of pins occupies the remaining channel.

8. The combination recited in claim 7 including:

a decorative element supported by said support arm.

9. The combination recited in claim 8 including:

a central body, said central body having a tubular extension to which said connector ring is mounted;

a plurality of light bulb arms connected to said central body.

* * * * *